US007095972B2

(12) United States Patent
Iwai

(10) Patent No.: US 7,095,972 B2
(45) Date of Patent: Aug. 22, 2006

(54) TONER IMAGE TRANSFER METHOD, TONER IMAGE TRANSFER DEVICE AND IMAGE FORMING APPARATUS

(75) Inventor: Sadayuki Iwai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 203 days.

(21) Appl. No.: 10/739,279

(22) Filed: Dec. 19, 2003

(65) Prior Publication Data

US 2004/0170451 A1 Sep. 2, 2004

(30) Foreign Application Priority Data

Dec. 19, 2002 (JP) ..... 2002-368809

(51) Int. Cl.
*G03G 15/01* (2006.01)

(52) U.S. Cl. ..... 399/299; 399/66

(58) Field of Classification Search ..... 399/66, 399/297–299, 301, 302, 308, 388
See application file for complete search history.

(56) References Cited

U.S. PATENT DOCUMENTS 5,708,938 A 1/1998 Takeuchi et al.
5,809,388 A 9/1998 Inada et al.
5,864,737 A 1/1999 Obu et al.
5,923,930 A 7/1999 Tsukamoto et al.
5,987,281 A 11/1999 Kurotori et al.
5,987,282 A 11/1999 Tsukamoto et al.
6,026,269 A * 2/2000 Setoriyama ..... 399/302
6,115,576 A 9/2000 Nakano et al.
6,347,212 B1 2/2002 Kosugi et al.
6,611,672 B1 8/2003 Aoki et al.

FOREIGN PATENT DOCUMENTS

JP 7-271201 10/1995
JP 9-146334 6/1997

* cited by examiner

*Primary Examiner*—Hoang Ngo
(74) *Attorney, Agent, or Firm*—Oblon, Spivak, McClelland, Maier & Neustadt, P.C.

(57) ABSTRACT

A toner image transfer method for transferring a toner image formed on a latent image carrier onto a transfer image carrier. A reference running speed of the latent image carrier VA and a reference running speed of the transfer image carrier VB are set substantially as VA=VB=V. A relative speed ΔV between the latent image carrier and the transfer image carrier is changed in vibration at a high speed to positive and negative sides around the reference running speed V, thereby to carry out an image transfer.

22 Claims, 8 Drawing Sheets

TONER IMAGE TRANSFER METHOD, TONER IMAGE TRANSFER DEVICE AND IMAGE FORMING APPARATUS

CROSS-REFERENCE TO RELATED APPLICATIONS

The present document incorporates by reference the entire contents of Japanese priority document, 2002-368809 filed in Japan on Dec. 19, 2002.

BACKGROUND OF THE INVENTION

1) Field of the Invention

The present invention relates to a toner image transfer method, a toner image transfer device, and an image forming apparatus.

2) Description of the Related Art

An image forming apparatus forms an electrostatic latent image onto a latent image carrier, develops the electrostatic latent image to obtain a toner image, and transfers the toner image onto a paper and fixes the toner image, thereby to obtain an image. A digital copying machine, an optical printer, an optical plotter, and a facsimile machine or the like are the example of the image forming apparatus. Color image forming apparatuses capable of forming color images have also appeared on the market.

A one-drum type and a tandem type are the major types of the color image forming apparatuses.

The one-drum type color image forming apparatus has a single drum-shaped latent image carrier. The one-drum type color image forming apparatus forms and develops electrostatic one-color latent images of three or four colors on the latent image carrier. The colors are selected from magenta, yellow, cyan, and black. The one-color latent images are transferred and superimposed onto one paper thereby obtaining a full color image.

The tandem type color image forming apparatus has a drum-shaped latent image carrier for each of the three or four colors. An electrostatic latent image corresponding to a predetermined color is formed on a corresponding one of the latent image carrier. The latent images are then developed with a toner of corresponding color, thereby to obtain color toner images. The color toner images are then transferred and superimposed onto a paper thereby obtaining a full color image.

Two transferring methods are known for transferring the toner images onto the paper: direct transfer and intermediate transfer. In the direct transfer, color toner images are directly transferred from the latent image carriers to the paper. In the intermediate transfer, the toner images on the latent image carriers are first transferred to an intermediate transfer medium such as an intermediate transfer belt and then transferred onto the paper.

In both types, a toner image is transferred and superimposed on the toner image that is transferred earlier. However, many times the toner image transferred earlier is not completely fixed. If a toner image is superimposed over an earlier not-fixed toner image, toner of the not-fixed toner image gets adhered to the latent image carrier. This phenomenon is called reverse transfer.

The reverse transfer disturbs the toner image that is transferred earlier, and this becomes a cause of degrading the quality of the color image that is finally obtained.

One approach is to clean residual toner from the latent image carrier before transferring a new image. The residual toner may be collected and reused. However, the toner recovered contains a mixture of toners of different colors so that the toner recovered can not be used as it is, or if used, color reproducibility of a color image or a multi-color image is lost substantially.

As described in Japanese Patent Application Laid-open No. H9-146334, one approach to reduce the reverse transfer is to set a contact angle of the latent image carrier relative to water equal to or more than 85 degrees. However, this approach is insufficient to reduce the reverse transfer.

As described in Japanese Patent Application Laid-open No. H7-271201, another approach to reduce the reverse transfer is to run the intermediate transfer medium faster than the latent image carrier.

The inventor has also confirmed the effect of this method by experiment. FIG. 1 is a graph of a reverse transfer rate of a yellow toner image (at the right ordinate) and a transfer rate of a magenta toner image (at the left ordinate), when the running speed of the intermediate transfer medium (i.e., the intermediate transfer belt) is different from that of the latent image carrier (i.e., a drum-shaped photoconductive photosensitive member).

The abscissa of the graph shown in FIG. 1 represents a linear velocity ratio that is defined as $(Vb-Va)/Va)\times 100$ (%), where Va is the running speed of the latent image carrier, and Vb is the running speed of the intermediate transfer medium. The linear velocity ratio is zero when Vb is equal to Va, that is, when the running speed of the latent image carrier is equal to the running speed of the intermediate transfer medium.

When an absolute value of the linear velocity ratio becomes larger, a reverse transfer rate 1-1 of the yellow toner image decreases, and a reverse transfer rate 1-2 of the magenta toner image increases.

Thus, when the running speed of the latent image carrier is different from that of the intermediate transfer medium, the transfer rate improves and the reverse transfer rate decreases. This is considered for the following reason. When the running speeds are set different, a relative displacement occurs between the latent image carrier and the intermediate transfer medium. The toner image that is in a stable state on the latent image carrier becomes in an unstable state, and Van der Waals' forces between the toner image and the latent image carrier decrease. Electrostatic adhesive force to the latent image carrier effectively decreases when a distance between the toner and the latent image carrier increases. Therefore, the transfer rate increases, and the reverse transfer rate decreases.

However, if the running speed of the latent image carrier if different from that of the intermediate transfer medium, although the reverse transfer does not occur, the image quality lowers.

In other words, a transfer section where the toner image is transferred from the latent image carrier to the intermediate transfer medium is formed as a nip section where the latent image carrier and the intermediate transfer medium are brought into contact with each other. During a period when the toner image that is transferred onto the intermediate transfer medium passes through the nip width of the transfer section, the side of the toner image that is in contact with the intermediate transfer medium and the side of the toner image that is in contact with the latent image carrier receive mutually opposite forces in the running direction because of the difference in the running speeds.

Therefore, when the toner passes through the transfer section, the toner image is deformed to be extended to the running direction.

FIG. 2 is an explanatory graph of a change or an extension in the length of a two-dot line image due to the linear speed rate, when the two-dot line image (i.e., an image of two dots) that is formed on the latent image carrier in a direction orthogonal with the running direction is transferred onto the intermediate transfer medium (i.e., the intermediate transfer belt).

The abscissa represents a linear velocity ratio. When the linear speed rate is zero, that is, when the running speed of the latent image carrier is equal to that of the intermediate transfer medium, a value of 140 micrometers on the ordinate is the length of the two-dot line image on the latent image carrier, where one dot has 70 micrometers.

It is clear that when an absolute value of the linear speed rate in both the plus and minus sides increases, the length of the transferred two-dot line image increases, where a dot mark represents an actual measurement value, and straight lines 2-1 and 2-2 represent theoretical values.

The extension of the transfer toner image is determined based on a relative moving distance brought by the running speed difference. In other words, when the transfer toner image passes through the nip width of the transfer section at a constant speed difference $\Delta v$ (=Vb−Va), the relative moving distance difference between the latent image carrier and the intermediate transfer medium becomes a product of a transmission time Tn and the speed difference $\Delta v$, that is, Tn times $\Delta v$.

The extension of the transfer toner image is not so conspicuous when the resolution of the image forming apparatus itself is low. However, under the recent situation that high resolution and a high-precision image are progressing, the extension of the transfer toner image becomes a serious problem.

The extension of the transfer toner image occurs due to the difference in the running speeds when the transfer toner image passes through the nip width of the transfer section. Therefore, in order to reduce the extension, the difference in the running speeds can be made smaller or the nip width can be made smaller. However, there is a physical limit to a reduction in the nip width. When the difference in the running speeds is made smaller, the effect of reducing the reverse transfer also decreases.

SUMMARY OF THE INVENTION

It is an object of the present invention to solve at least the problems in the conventional technology.

A method for transferring a toner image from a latent image carrier to a transfer image carrier, according to one aspect of the present invention, includes running the latent image carrier at a reference running speed VA and running the transfer image carrier at a reference running speed VB, wherein VA=VB; and transferring the toner image from the latent image carrier to the transfer image carrier while controlling at least one of the latent image carrier and the transfer image carrier in such a manner that a relative speed $\Delta V$ of the latent image carrier and the transfer image carrier changes abruptly and at high speed to positive and negative sides of a reference running speed V, where V=VA=VB.

A toner image transfer device according to another aspect of the present invention includes a latent image carrier with a toner image; a transfer image carrier onto which the toner image from the latent image carrier is to be transferred; a latent image carrier driving unit that drives the latent image carrier at a reference running speed VA; a transfer image carrier running unit that runs the transfer image carrier, while bringing the transfer image carrier into contact with the latent image carrier, at a reference running speed VB that is substantially equal to the reference running speed VA of the latent image carrier driving unit; a transfer image carrier driving unit that drives the transfer image carrier running unit; a transfer unit that applies a transfer voltage to a contact portion between the latent image carrier and the transfer image carrier; and a controller that controls at least one of the latent image carrier driving unit and the transfer image carrier driving unit in such a manner that a relative speed $\Delta V$ of the latent image carrier and the transfer image carrier changes abruptly and at high speed to positive and negative sides of a reference running speed V, where V=VA=VB.

An image forming apparatus according to another aspect of the present invention includes the toner image transfer device according to the present invention.

The other objects, features and advantages of the present invention are specifically set forth in or will become apparent from the following detailed descriptions of the invention when read in conjunction with the accompanying drawings.

DETAILED DESCRIPTION

Exemplary embodiments of a toner transfer method, a toner transfer device, and an image forming apparatus according to the present invention are explained below with reference to the accompanying drawings.

Figure 3A:
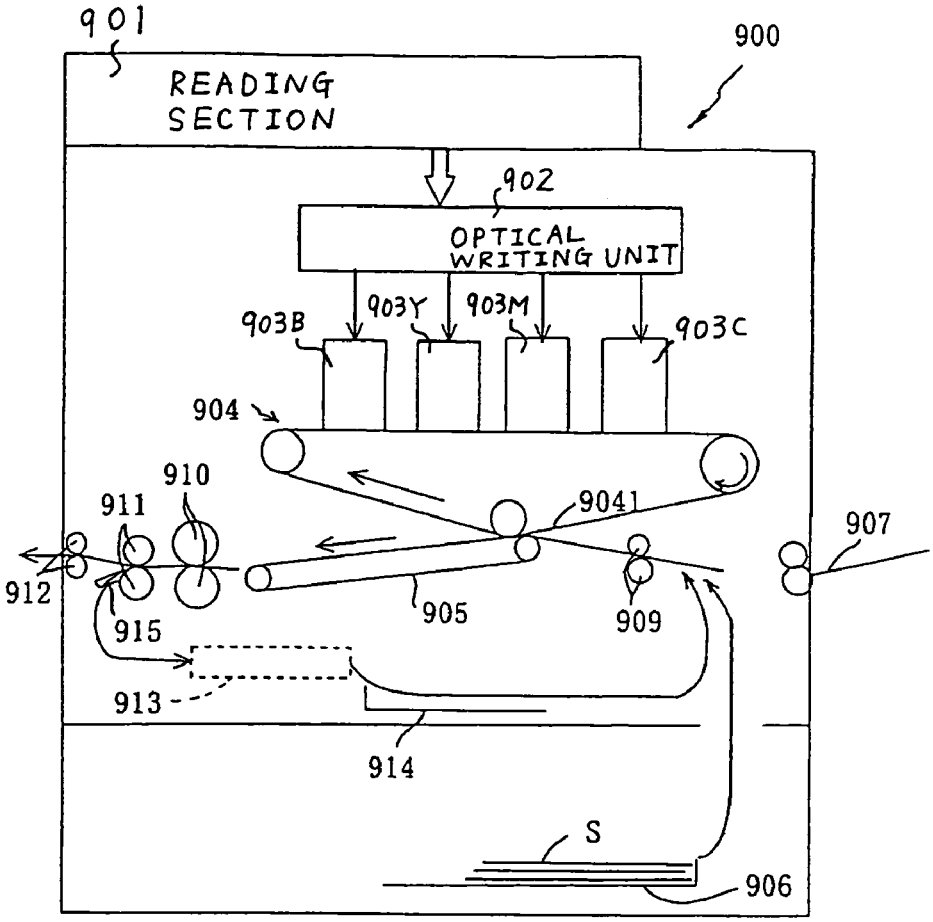
FIGS. 3A and 3B illustrate an image forming apparatus according to an embodiment of the present invention.

FIG. 3A illustrates an image forming apparatus 900 according to an embodiment of the present invention. This image forming apparatus 900 is a tandem type color image forming apparatus. This image forming apparatus 900 includes a reading section 901 that reads a color document by separating colors into red, green, and blue. Based on the read information, image data is generated corresponding to each color of black (B), yellow (Y), magenta (M), and cyan (C).

An optical writing unit 902 supplies the image data to image creation stations 903B, 903Y, 903M, and 903C respectively to optically write images. Each of the image creation stations 903B, 903Y, 903M, 903C has the same configuration, and therefore, they will be explained by taking the image creation station 903B as an example.

Figure 3B:
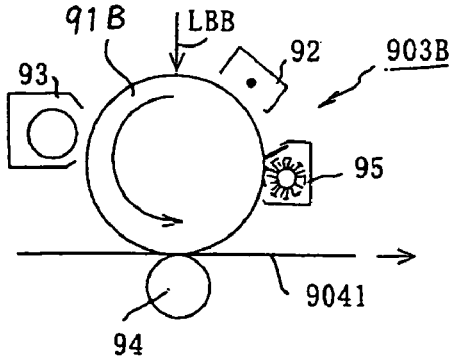

FIG. 3B illustrates a detailed structure of the image creation station 903B. The image creation station 903B has a charger 92, a developing unit 93, a transfer roller 94, and a cleaning unit 95 that are disposed around a drum-shaped photosensitive member 91B. The photosensitive member 91B is a latent image carrier and it rotates in the counterclockwise direction as shown by an arrow. The photosensitive member 91B is photoconductive.

An intermediate transfer belt 9041 of a primary transfer unit 904 runs between the photosensitive member 91B and the transfer roller 94 (see FIG. 3A). The charger 92 uniformly charges the photosensitive member 91B while it rotates in the counterclockwise direction. A laser beam LBB writes B image data corresponding to a black image onto the photosensitive member 91B thereby to form a B latent image. The developing unit 93 develops the B latent image in reverse to form a B toner image using a black toner. The transfer roller 94 transfers the B toner image onto the intermediate transfer belt 9041. The cleaning unit 95 cleans the photosensitive member 91 after the transfer of the toner image.

Similarly, the image creation stations 903Y, 903M, and 903C shown in FIG. 3A form color toner images of Y (yellow), M (magenta), and C (cyan) respectively. These toner images of Y, M, and C are transferred onto the intermediate transfer belt 9041 such that the toner images are superimposed with the B toner image. A color image obtained from the toner images of B, Y, M, and C that are formed on the intermediate transfer belt 9041 is transferred onto a sheet of transfer paper S as a sheet recording medium.

The transfer paper S is fed from a cassette 906 provided at a lower side of the image forming apparatus or is fed manually from a manual paper feeder 907. A resist roller 909 feeds the transfer paper S to a transfer section, that is, a contact portion between the intermediate transfer belt 9041 and a secondary transfer belt 905 under a timing control during the move of the color image. The color image is transferred according to the operation of a transfer bias that is applied from a bias application unit not shown to the secondary transfer belt 905. The secondary transfer belt 905 and the bias application unit not shown constitute a secondary transfer unit.

The secondary transfer belt 905 conveys the transfer paper S onto which the color image is transferred. A neutralization charger (not shown) removes the electric charge from the transfer paper S, and releases the paper from the secondary transfer belt 905. A fixing unit 910 fixes the color image. A conveyer roller 911 conveys the transfer paper S, and a discharging roller 912 discharges the paper to the outside of the apparatus.

In a two-sided image forming mode of forming images onto both sides of the transfer paper S, a switching claw 915 switches over the conveying route of the transfer paper S onto one surface of which a color image is formed. The conveyer roller 911 and a guide not shown convey the transfer paper S to a reversing section 913. The reversing section 913 reverses the transfer paper S, stacks the paper onto a stacker 914, with the surface formed with the color image faced upward, and conveys the paper to the position of the resist roller 909 again. A color image is transferred onto the back surface of the paper in a similar manner to the above. Thereafter, the fixing unit 910 fixes the color image on the back surface. The conveyer roller 911 conveys the transfer paper S, and discharges the paper to the outside of the apparatus with the discharging roller 912.

Figure 4A:
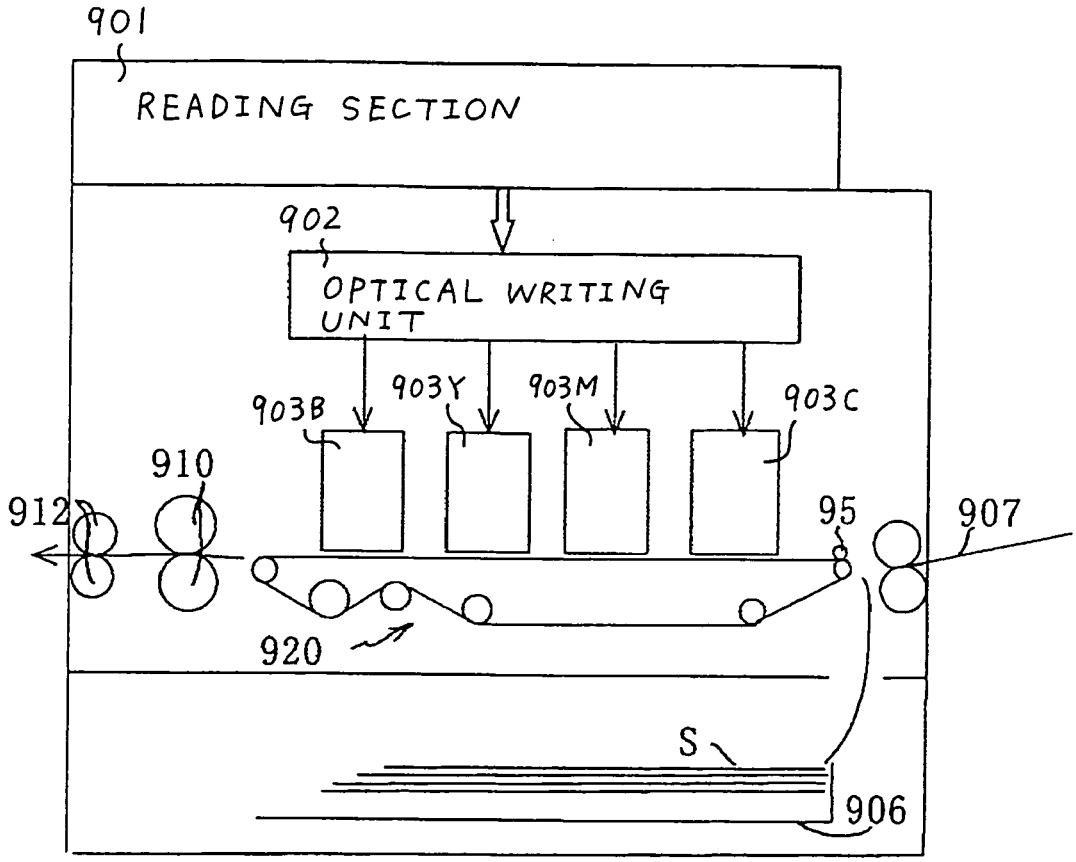
FIGS. 4A and 4B illustrate an image forming apparatus according to another embodiment of the present invention.

FIG. 4A illustrates an image forming apparatus according to another embodiment of the present invention. In order to avoid complexity, like parts, which are considered not to be confusing, are designated with like reference numerals shown in FIGS. 3A and 3B, and the same explanation as that made in FIGS. 3A and 3B is applied to these parts.

The image forming apparatus shown in FIG. 4A is also a tandem type color image forming apparatus. The reading section 901 reads a color document by separating colors into red, green, and blue. Based on the read information, image data is generated corresponding to each color of B, Y, M, and C. The optical writing unit 902 supplies the image data to the image creation stations 903B, 903Y, 903M, and 903C respectively.

Figure 4B:
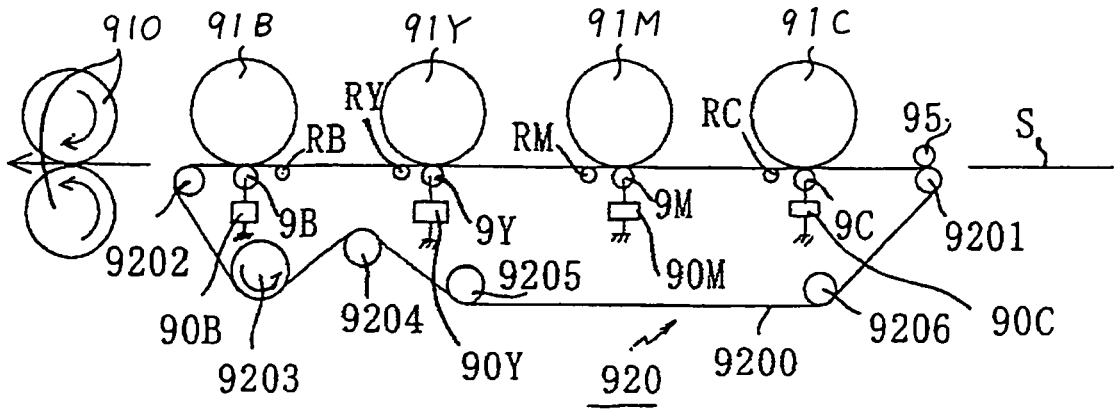

FIG. 4B illustrates a detailed structure of a transfer device 920. As shown in FIG. 4B, the upper surface of a sheet conveyer belt 9200 is applied to the lower sides of the drum-shaped photosensitive members 91B, 91Y, 91M, and 91C respectively that are used in the respective image creation stations.

The sheet conveyer belt 9200 is applied to rollers 9201, 9202, 9203, 9205, and 9206 respectively. The driving rollers 903 rotate the sheet conveyer belt 9200 in the counterclockwise direction. A roller 9204 is a tension roller, which gives belt tensile force that is necessary for the sheet conveyer belt 9200, and increases the winding angle of the sheet conveyer belt 9200 around a driving roller 9203, thereby to securely transfer the driving force of the driving roller 9203 to the sheet conveyer belt 9200.

At the inner peripheral surface side of the sheet conveyer belt 9200, transfer rollers 9B, 9Y, 9M, and 9C are pressed against corresponding photosensitive members 91B, 91Y, 91M, and 91C, via the sheet conveyer belt 9200. Pressing rollers RB, RY, RM, and RC that are provided in the vicinity of these transfer rollers work to push the sheet conveyer belt 9200 upward so that the sheet conveyer belt 9200 forms a nip section (i.e., transfer section) of a desired width to each photosensitive member.

Transfer bias is applied from bias power sources 90B, 90Y, 90M; and 90C onto the transfer rollers 9B, 9Y, 9M, and 9C respectively.

When the toner image is transferred, a resist roller not shown feeds the transfer paper S as a sheet recording medium to the sheet conveyer belt 9200.

The charging roller 95 and the sheet conveyer belt 9200 sandwich the fed transfer paper S and conveys the paper. The charging roller 95 charges the paper, and electrostatically adheres the paper to the external periphery of the sheet conveyer belt 9200. The photosensitive members 91C, 91M, 91Y, and 91B sequentially transfer the C toner image, the M toner image, the Y toner image, and the B toner image onto the transfer paper S to form a color image on the transfer paper.

After the transfer of the color toner images, a neutralization unit not shown removes the electric charge from the transfer paper S, separates the paper from the sheet conveyer belt 9200, and supplies the paper to the fixing unit 910. The fixing unit 910 fixes the image, and discharges the paper to the outside of the apparatus.

The transfer rollers 9Y, 9M, and 9C and the pressing rollers RY, RM, and RC are integrated, and can be evacuated from the photosensitive members 91Y, 91M, and 91C by a mechanism not shown. Only the transfer roller 9B works in an image creation mode of forming a monochromatic image using only one black color.

On the other hand, in an image creation mode of not forming the black image, the transfer rollers 9Y, 9M, and 9C and the pressing rollers RY, RM, and RC are set in an operating state. A mechanism not shown evacuates the transfer roller 9B and the pressing roller RB from the photosensitive member 91B, and sets them to a non-operating state.

Figure 5A:
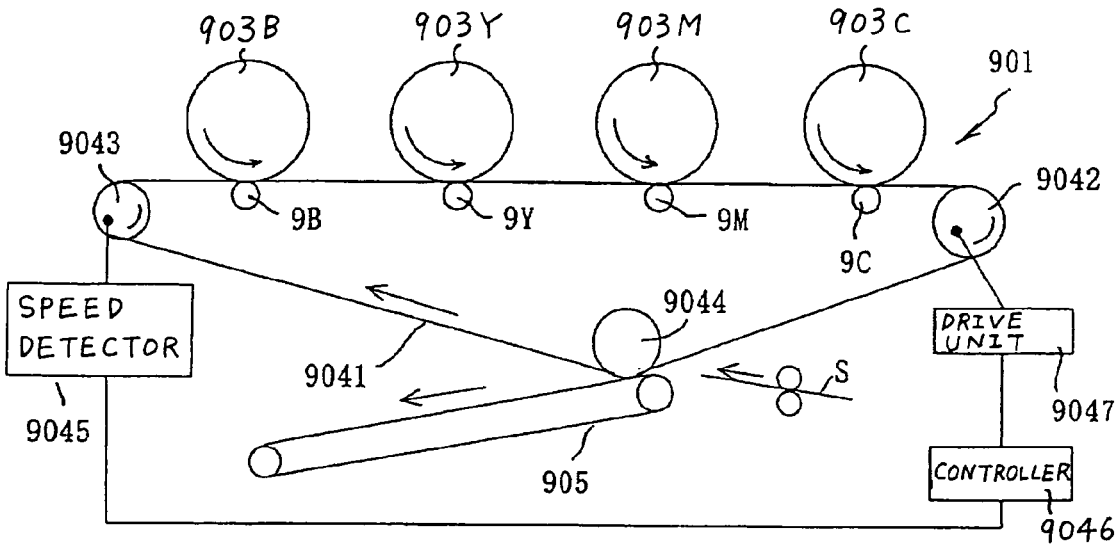
FIGS. 5A and 5B illustrate a toner image transfer device according to an embodiment of the present invention.

FIG. 5A illustrates a portion of the toner image transfer device in the image forming apparatus shown in FIG. 3A.

Reference numerals 903B, 903Y, 903M, and 903C denote drum-shaped photoconductive photosensitive members similar to those shown in FIG. 3A. Reference numerals 9B, 9Y, 9M, and 9C denote transfer rollers.

For the sake of explanation, it is assumed that the photosensitive members 903B, 903Y, 903M, 903C are controlled to rotate by the encoder to such that the running speed of the transfer section becomes a reference running speed VA. On the other hand, an intermediate transfer belt 9041 is applied to a driving roller 9042, a subordinate roller 9043, and a tension roller 9044. A drive unit 9047 rotates the driving roller 9042 in the clockwise direction. In the present embodiment, the drive unit 9047 is a direct current (hereinafter, "DC") motor having a braking function.

When the intermediate transfer belt 9041 rotates, a speed detector 9045 that uses an encoder detects the rotation of the subordinate roller 9043 in real time. A controller (that is a part of the function of a microcomputer that controls the whole of the image forming apparatus) 9046 takes in the output of the detection.

The controller 9046 corrects a variation in the running speed of the intermediate transfer belt due to the eccentricity of the driving roller 9042 and the difference of the belt thickness, and controls the running speed of the transfer section to become a reference running speed VB. The reference running speeds VA and VB are substantially VA=VB=V.

The controller 9046 also controls the drive unit 9047, and changes the running speed of the intermediate transfer belt 9041 to vibrate at a high speed. Based on the change in the running speed, the running speed of the transfer section of the intermediate transfer belt 9041 has a relative speed of ΔV relative to the running speed of each photosensitive member. The relative speed of ΔV changes to positive and negative sides at a high speed in vibration around the reference running speed V.

Figure 5B:
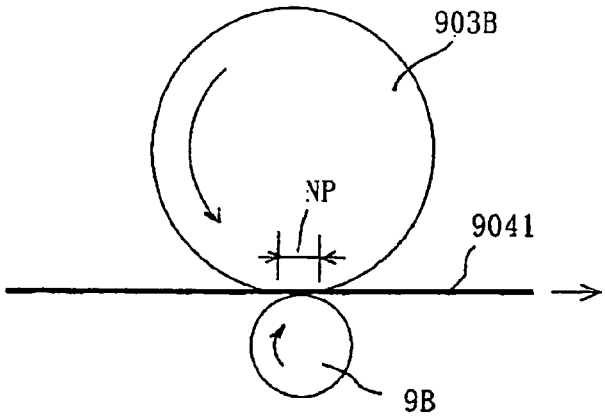

FIG. 5B illustrates a contact section between the photosensitive member 903B and the intermediate transfer belt 9041. The transfer roller 9B presses the intermediate transfer belt 9041 against the photosensitive member 903B, and forms a nip section of a nip width NP as the transfer section between the intermediate transfer belt 9041 and the photosensitive member 903B. Other transfer section also forms a similar configuration.

It is assumed that the relative speed ΔV changes according to a prescribed waveform g(t). The "prescribed waveform" means that the reference running speed V is 1. As described above, a change width of the relative speed relative to the reference running speed V, that is, ΔVmax/V is a coefficient α.

Then, the change in the relative speed ΔV is expressed as $$\Delta V=\alpha\cdot V\cdot g(t)$$

where g(t) represents the waveform, α represents the coefficient, and V represents the reference running speed.

It is ideal that ΔV is the same as the waveform that the controller 9046 makes the drive unit 9047 change. In actual practice, the frequency of the waveform g(t) is high, and the apparatus has response characteristics. Therefore, the waveform does not become the same as the waveform generated by the controller 9047. However, because of the response characteristics of the apparatus due to the inertia or the like, the waveform of ΔV does not become the waveform as assumed. It is general that the waveform becomes a one that can be approximated as a sinusoidal waveform.

Figure 6A:
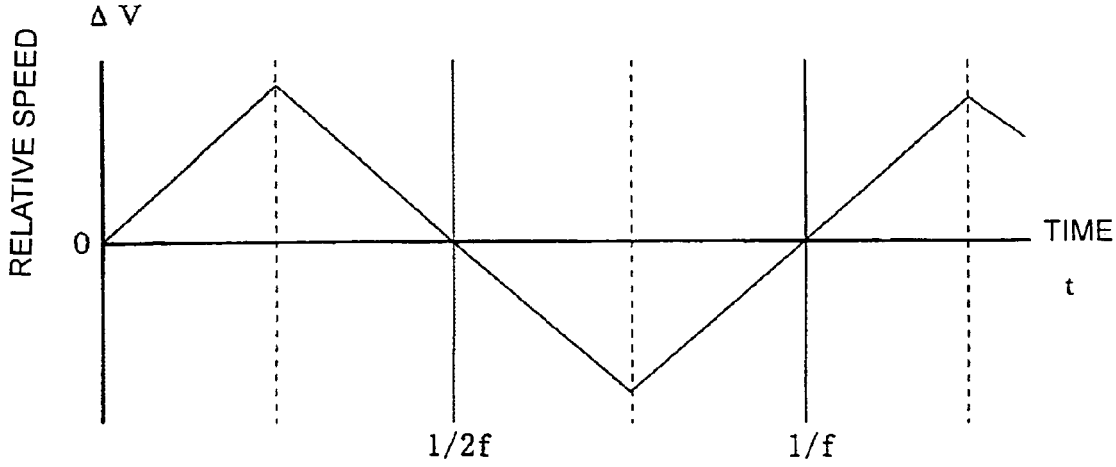
FIGS. 6A and 6B are explanatory graphs of the principle of an image forming apparatus according to the present invention.

To simplify the explanation, as shown in FIG. 6A, the time change of the relative speed ΔV is in the form of a vibration of linear increase and decrease will be explained as a model.

When the reference frequency of the vibration is f (hertz), the vibration cycle of ΔV becomes 1/f.

As described above, the running speed of the photosensitive member as a latent image carrier is the reference running speed V, and the reference running speed of the intermediate transfer belt as the transfer image carrier is also V. In this state, when the intermediate transfer belt is observed from the running photosensitive member in the transfer section, the surface of the intermediate transfer belt looks such that the running speed varies as shown in FIG. 6A.

Because of this speed variation, the surface of the intermediate transfer belt is displaced in vibration as observed from the photosensitive member. In this case, the displacement, that is, a relative displacement D on the surface of the intermediate transfer belt relative to the photosensitive member is given as integration $$\int \Delta V(t)dt.$$

Figure 6B:
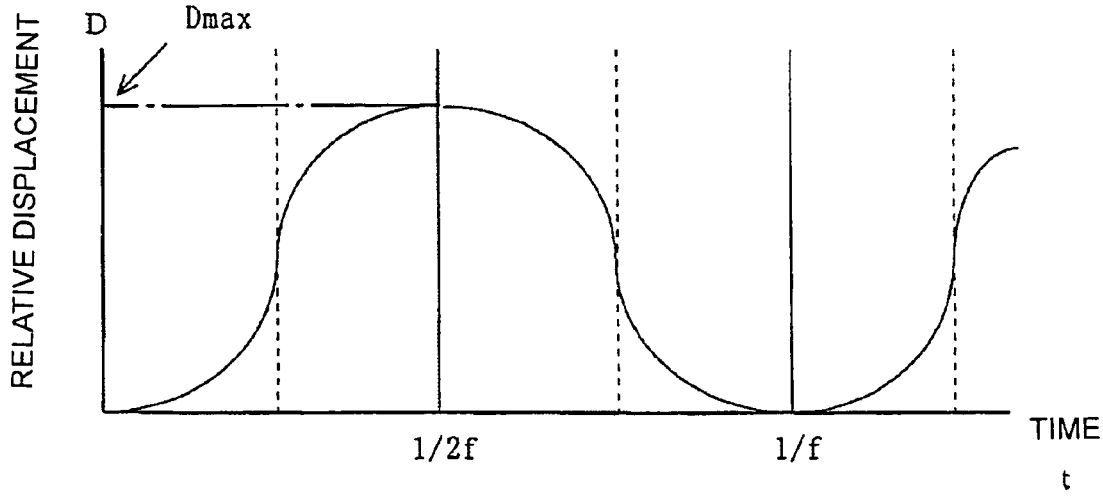

When the change in the relative speed ΔV is linear as shown in FIG. 6A, the value of the integration changes in a waveform along the change in time t as shown in FIG. 6B. A portion convex downward from the waveform and a portion convex upward from the waveform are parabolic.

As is clear from FIG. 6B, the relative displacement D becomes a maximum value Dmax at a portion of a half of one cycle 1/f of the change in ΔV, that is, when t=½f. The relative displacement Dmax becomes a value of integrating the integrating the above integration ∫ΔV (t) dt from time t=0 to ½f.

In other words, when the above ΔV=α·V·g(t) is used, the relative displacement Dmax is expressed as a definite integration $$d > \alpha\cdot V\cdot\int_{t=0}^{1/(2f)} g(t)\cdot dt.$$

As the coefficient α and the reference running speed V can be regarded as constants, the integration can be expressed as:

$$D\max = \alpha\cdot V\cdot\int_{t=0}^{1/(2f)} g(t)\cdot dt.$$

The integration of the right-hand side is the above definite integration.

When the toner image on the photosensitive member is transferred onto the intermediate transfer belt, in the transfer section, one side of the toner image is in contact with the intermediate transfer belt, and the other side of the toner image is in contact with the photosensitive member. A maximum displacement generated to the toner image between the intermediate transfer belt side and the photosensitive member side is the above Dmax.

Therefore, assume that the coefficient α, the average speed V, the waveform g(t), and the basic frequency f (hertz) satisfy $$d > \alpha \cdot V \cdot \int_{t=0}^{1/(2f)} g(t) \cdot dt,$$

for the minimum resolution distance d (millimeters) that is desired for the toner image which is transferred onto the intermediate transfer belt. Then, even when the relative speed ΔV relative to the photosensitive member of the running speed of the intermediate transfer belt changes in vibration, the transferred toner image satisfies a minimum resolution distance that is desired for the toner image. The reduction in the resolution due to the transfer does not damage the resolution that is required for the transfer image.

On the other hand, when the relative speed difference ΔV is set between the running speed of the photosensitive member and that of the intermediate transfer belt, the toner image that is in the stable state on the photosensitive member becomes unstable. The Van der Waals' forces and electrostatic adhesive force between the toner image and the photosensitive member decrease. Therefore, the transfer rate improves, and the reverse transfer rate decreases.

While the change in the relative speed ΔV is explained as a model as shown in FIG. 6A, there is no particular limit to the waveform g(t) that determines the change in ΔV. As explained above, the waveform can be approximated as the sinusoidal waveform.

Assume that $g(t)=\sin(2\pi ft)$. Then, $\Delta V=\alpha \cdot V \cdot \sin(2\pi ft)$. The definite integration $\int g(t)\,dt$ that assumes t=0 as a lower limit and t=½f as an upper limit becomes:

$$\int \sin(2\pi ft)dt = -\cos(2\pi ft)/2\pi f(t=0 \text{ to } \tfrac{1}{2}f) = 1/(2\pi f) - \{-1/(2\pi f)\} = 1/(\pi f).$$

Therefore, the above conditional expression $$d > \alpha \cdot V \cdot \int_{t=0}^{1/(2f)} g(t) \cdot dt$$

becomes as follows:

$$d > \alpha \cdot V/(\pi f) \text{ (millimeters).}$$

Therefore, when this condition is satisfied, it is possible to improve the transfer efficiency and effectively decrease the reverse transfer while satisfying the resolution that is required for the transfer toner image.

For the above minimum resolution distance d (millimeters), when the write density is 600 dots per inch, for example, one dot size is 42.3 micrometers. Therefore, it is sufficient when Dmax is not larger than this value.

For example, assume that the nip width NP (refer to FIG. 5B) of the transfer section is 5 millimeters between the photosensitive member that runs at 250 mm/s and the intermediate transfer belt. When the speed variation of the frequency 1 kilohertz and the variation amplitude 1% is given to the intermediate transfer belt side, the time Tn during which the photosensitive member passes through the nip width NP=5 millimeters is 20 milliseconds. Therefore, while the photosensitive member passes through the nip width, an inversion to the direction of the relative speed occurs by twenty times on the intermediate transfer belt.

Therefore, the time during which the photosensitive member passes through the nip width little affects the extension of the transfer toner image, as compared with when the constant running speed difference ΔV is applied to between the photosensitive member and the intermediate transfer belt like the conventional practice. Consequently, the extension of the transfer toner image is determined according to only the relative moving distance $\alpha \cdot V \cdot \int g(t)\,dt$ during the vibration change half-cycle of the relative speed ΔV (i.e., the above ½f).

In the above explanation, one cycle is 1 microsecond, α=1%=0.01, V=250 mm/sec, and ½f=0.5 microseconds. Therefore, the maximum relative moving distance Dmax becomes $\alpha \cdot V/(\pi f)=0.01\times250/(1000\times3.14)$ 0.0008 millimeters=0.8 micrometers. Consequently, even when the speed varies, the extension of the toner image is minute, which can be practically disregarded.

On the other hand, when the intermediate transfer belt runs with an increased running speed by one percent relative to the photosensitive member, the displacement between the surface of the photosensitive member and the surface of the intermediate transfer belt during the passing of the photosensitive member through the nip width becomes 20 ms·0.01·250 mm/s 50 microseconds when the nip width is 5 millimeters and the running speed is 250 mm/s like in the above example. The displacement cannot be disregarded as the disturbance of the image.

Various kinds of waveforms g(t) can be considered that are given to the relative speed ΔV. While the rectangular wave is one of preferable waves, it is difficult to actually give the wave in the toner image transfer device. In order to give the rectangular wave with a stepping motor when the device is mounted on the actual machine, control of relatively high frequency is necessary.

On the other hand, the above sinusoidal wave has a mild change, and has an area where substantially no linear speed difference occurs. It is not difficult to give the wave, and the image is less damaged due to unreasonable control. Therefore, the wave is preferable in actual practice. The rectangular wave that is preferable as the waveform g(t) is also a group of sinusoidal waves having different frequencies. Therefore, when the sinusoidal waves having different frequencies are also combined as well as the sinusoidal wave of a single frequency, a further effect can be expected.

When the frequency f of the change of the relative speed ΔV is too low, the above influence of the nip width appears. When the reference frequency f is 10 hertz, for example, the time taken for the intermediate transfer belt and the photosensitive member to pass through the nip NP is 100 milliseconds when the running speed is 250 mm/s. In this case, the above $\alpha \cdot V/(\pi f)$ becomes $0.01\times250/(10\times3.14)$ 0.08 millimeters=80 micrometers. Consequently, the extension of the transfer toner image is very conspicuous. When f is about 50 hertz, the extension of the transfer toner image is as large as about 15 microns, and the image disturbance is conspicuous.

In the toner image transfer method according to the present invention, the relative speed ΔV is changed in vibration at a high speed to positive and negative sides around the reference running speed V. The change is carried out in order to avoid the occurrence of the influence of the nip width of the transfer section in the transfer toner image.

In general, when the frequency is about 4 cycles/mm, or preferably equal to or more than 6 cycles/mm on the image formed on the sheet recording medium, the influence of the nip width is hardly visible to the human eyes.

Therefore, it is preferable that the frequency f of the relative speed ΔV, satisfies f/V (i.e., times/mm) is equal to or more than four, preferably equal to or more than six.

While the intermediate transfer belt (i.e., the intermediate transfer medium) changes the relative speed ΔV in the above explanation, the photosensitive member (i.e., the latent image carrier) can also change the relative speed ΔV.

The toner image transfer device according to the embodiment explained with reference to FIGS. 5A and 5B includes latent image carriers 903B, 903Y, 903M, 903C with toner images; a transfer image carrier 9041 onto which the toner images are to be transferred; a latent image carrier driving unit (not shown) that drives the latent image carriers at a reference running speed VA; a transfer image carrier running unit 9042, 9043, 9044 that runs the transfer image carrier, while bringing the transfer image carrier into contact with the latent image carrier, at a reference running speed VB that is substantially equal to the reference running speed VA of the latent image carrier driving unit; a transfer image carrier driving unit 9047 that drives the transfer image carrier running unit; a transfer unit 9B, 9Y, 9M, 9C that applies a transfer voltage to a contact portion between the latent image carrier and the transfer image carrier; and a controller 9046 that controls at least one of the latent image carrier driving unit and the transfer image carrier driving unit in such a manner that a relative speed ΔV of the latent image carrier and the transfer image carrier changes abruptly and at high speed to positive and negative sides of a reference running speed V, where V=VA=VB.

The controller 9046 controls the transfer image carrier driving unit 9047 so that the running speed of the transfer image carrier 9041 changes abruptly and at high speed to positive and negative sides of a reference running speed V.

On the contrary, the controller 9046 may control the latent image carrier driving unit so that the running speeds of the latent image carriers 903B, 903Y, 903M, 903C change abruptly and at high speed to positive and negative sides of a reference running speed V.

In general, as the drum-shaped photosensitive member that is used for a latent image carrier is a rigid body, the photosensitive member has an advantage in that the speed can be controlled in high precision. As a latent image needs to be written onto the photosensitive member, when the speed variation is large, there is a risk that a banding occurs in the latent image itself. In this case, a speed variation is given by deviating the phase to the photosensitive member and the intermediate transfer medium. With this arrangement, a similar effect can be obtained while suppressing the intensity of the variation.

When the speed variation of the latent image carrier and that of the transfer image carrier are in the same phase, the relative speed cannot be given. Therefore, these phases need to be deviated from each other. It is preferable that the displacement between the phases is about 180 degrees.

The number of latent image carriers is not limited to four. There may be only one latent image carrier or there may be three latent image carriers.

The transfer image carrier 9041 is an intermediate transfer medium, which is transferred with toner images from the latent image carriers 903B, 903Y, 903M, 903C, and which transfers these toner images onto the sheet recording medium. The transfer image carrier 9041 is also an endless belt-shaped intermediate transfer medium that is rotatably held. It is needless to mention that, in place of the endless belt-shaped intermediate transfer medium, a drum-shaped intermediate transfer medium that is rotatably held can be used.

In the above embodiment, the invention is applied to the toner image transfer device for the image forming apparatus shown in FIGS. 3A and 3B, and the transfer image carrier is the intermediate transfer belt. The invention can also be applied to the toner image transfer device for the image forming apparatus shown in FIGS. 4A and 4B. In this case, the intermediate transfer belt is the sheet recording medium S that is conveyed to the sheet conveyer belt 9200.

In other words, in the toner image transfer device shown in FIGS. 4A and 4B, the toner image transfer method according to the present invention is applied to the toner image transfer device in which the transfer image carrier is the sheet recording medium S, and the transfer image carrier running unit 920 rotatably holds the endless belt-shaped sheet holder 9200, which holds and conveys the sheet recording medium S.

The toner image transfer device illustrated in FIG. 5A is used in the image forming apparatus illustrated in FIG. 3A.

Further, according to the toner image transfer device, the plurality of latent image carriers 903B, 903Y, 903M, 903C that are disposed along the running path S of the transfer image carrier 9011 are used. Electrostatic latent images formed on the latent image carriers are developed using toners of different colors. The number of the latent image carriers 903B, 903Y, 903M, 903C is four. The electrostatic latent images on the different latent image carriers are developed separately using four color toners of magenta, yellow, cyan, and black.

In the image forming apparatus shown in FIGS. 3A and 3B, the transfer image carrier running unit 904 of the toner image transfer device is an endless belt-shaped intermediate transfer medium that is rotatably held. The transfer image carrier running unit 9041 may be a rotatable endless belt or a rotatable drum, and the image carrier running unit holds and conveys the transfer image carrier The latent image carriers 903B, 903Y, 903M, 903C are photoconductive photosensitive members.

The image forming apparatuses shown in FIGS. 3A and 3B and FIGS. 4A and 4B are tandem type image forming apparatuses. The tandem type image forming apparatus has a plurality of latent image carriers, and has one transfer image carrier. Therefore, as described in the above embodiment, when the photosensitive member as the latent image carrier is driven at the constant speed V and when the transfer image carrier gives the relative speed ΔV by control, the same effect can be expected at all the transfer positions by controlling only one transfer image carrier. This has a large cost advantage.

Detailed examples will be explained below. The image forming apparatus shown in FIGS. 3A and 3B is used for the explanation.

Each of the drum-shaped photosensitive members 903B, 903Y, 903M, 903C has a radius of 30 millimeters, and has write resolution of 600 dots per inch in both the main and sub scanning directions. A minimum pixel length on each photosensitive member in the sub scanning direction is 42.3 micrometers.

The toner image transfer device is as shown in FIGS. 5A and 5B.

Various kinds of materials can be used for the intermediate transfer belt 9041. It is preferable to use a belt made of polyimide having high Young's modulus with excellent rigidity, a Polyvinylidene Fluoride (PVDF) belt having excellent surface smoothness, and a multi-layer belt having an elastic surface that has a polyurethane layer on a polyurethane resin layer, and has a coating layer containing a fluorine component on top of the layer. Particularly, the polyurethane multi-layer belt has an elastic surface, which has excellent adhesiveness with the surface of the photosensitive member or the surface of paper, and is excellent in both primary transfer and secondary transfer. Each belt has volume resistance of about $10^{10}$ to $10^{12}$ ohmic centimeters. The surface resistance of the portion on which the toner is mounted has a characteristic of equal to or more than $10^{12}$ Ω/, and has excellent transfer characteristics.

The rigidity of the intermediate transfer belt is extremely important. In order to change the relative speed of the intermediate transfer belt 9041, the driving roller 9042 of the intermediate transfer belt must transmit a fine-controlled speed to the primary transfer position of each of the photosensitive members 903B, 903Y, 903M, 903C via the intermediate transfer belt 9041. Therefore, when the intermediate transfer belt expands or contracts and cannot transmit the given speed difference and absorbs the speed like a spring, the belt is useless.

Accordingly, in the following examples, a polyimide belt having excellent mechanical rigidity is used as the intermediate transfer belt 9041. The polyimide belt has a thickness of 90 micrometers, and Young's modulus of 7000 millipascal.

The driving roller 9042 of the intermediate transfer belt has a roller diameter of 30 millimeters. The driving roller 9042 is a rubber roller having a rubber layer with a thickness of 0.5 millimeters on the surface. As the driving roller is made of rubber, the processing precision cannot be as high, with a deflection precision of about 50 micrometers as a maximum. In this case, the variation in the running speed of the belt surface due to the deflection of the roller becomes about ±0.16%. The intermediate transfer belt 9041 has a variation in the running speed attributable to an error of the belt thickness and a variation of the Young's modulus.

When a laser Doppler displacement measuring gauge is used to actually measure the running speed of the surface of the intermediate transfer belt, the running speed has a variance of about ±0.25%. The speed variation in a very slow cycle of the belt driving roller rotation cycle (linear velocity of 245 mm/s, and about 2.6 hertz) is not desirable for the image quality. In order to cope with this problem, an encoder is fitted to the subordinate roller 9043 at the opposite side of the driving roller thereby to make it possible to detect the speed variation of intermediate transfer belt.

The running speed of the surface of the intermediate transfer belt is determined according to the speed variation and the thickness variation due to the eccentricity of the belt driving roller 9042. These values have cyclicity. Therefore., it is possible to remove the cyclicity by detecting and feeding back the running speed of the belt driving roller. The DC motor having the braking function is used for the drive unit 9047 that drives the intermediate transfer belt 9041.

Based on the above feedback control, low-frequency speed variation components can be removed, and high-frequency speed variation can be given.

The reference running speed V of the photosensitive members 903B, 903Y, 903M, 903C and the intermediate transfer belt 9041 is set to an average speed of 245 mm/s, respectively.

The DC motor having the braking function via the gear head is used to drive the driving axis pressured into photosensitive member flange section thereby to drive each of the photosensitive members 903B, 903Y, 903M, 903C. A reduction gear ratio is taken large. An exclusive arithmetic circuit is used to control the driving so as to be able to generate an optional frequency with optional amplitude.

The encoder fitted to the photosensitive flange section at the opposite side of the driving roller is used to always monitor the driving state of the photosensitive members 903B, 903Y, 903M, 903C. The encoder feeds back a result of the detection to the driving controller.

The processing precision of the photosensitive members 903B and others has a deflection precision of about 50 micrometers. A variation in the external peripheral speed is about ±0.08%. The low-frequency relative speed variation is fed back to the driving controller in a similar manner to the feedback of the speed variation of the transfer driving roller 9047. With this arrangement, the low-frequency speed variation components are removed. For the high-frequency variation components, a relative speed of constant amplitude intensity is given always in the constant frequency.

Figure 7B:
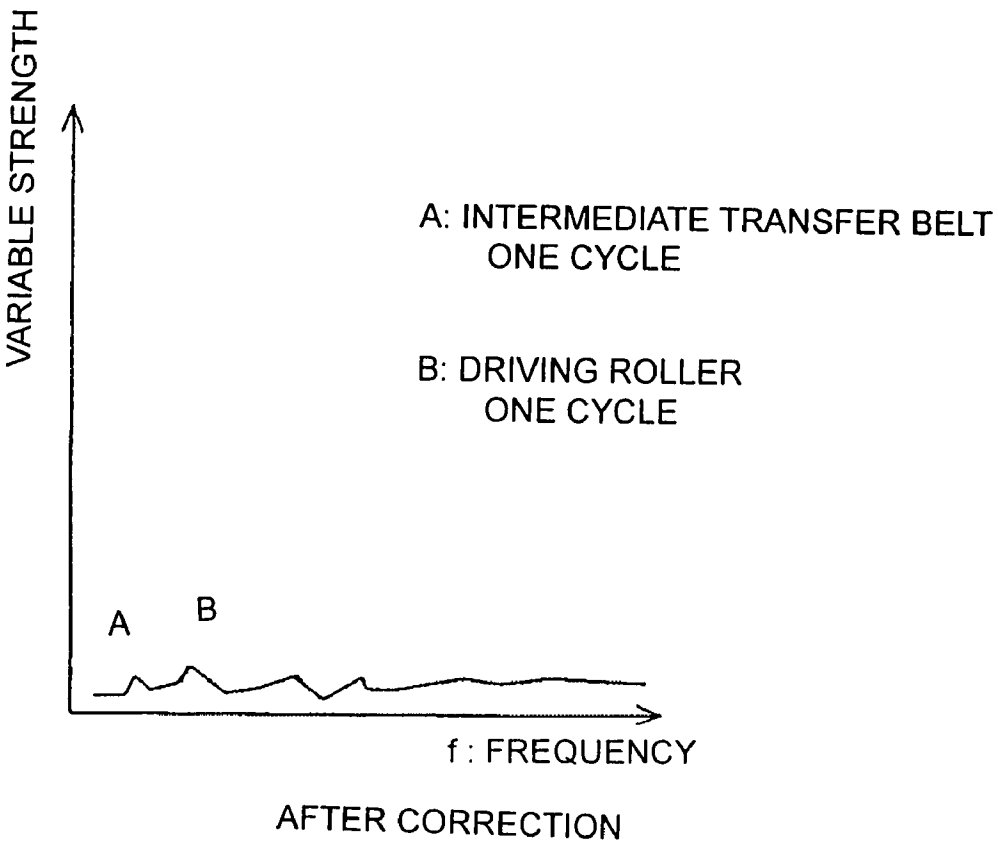
FIGS. 7A and 7B are explanatory graphs of a concept of a vibration spectrum of a running speed of an intermediate transfer belt according to the embodiment.
Figure 7A:
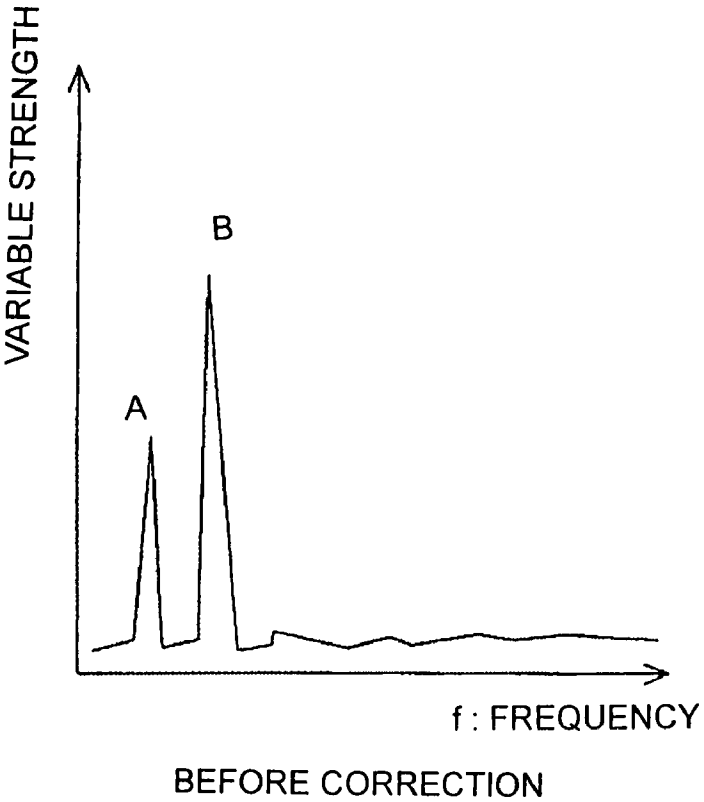
Figure 8:
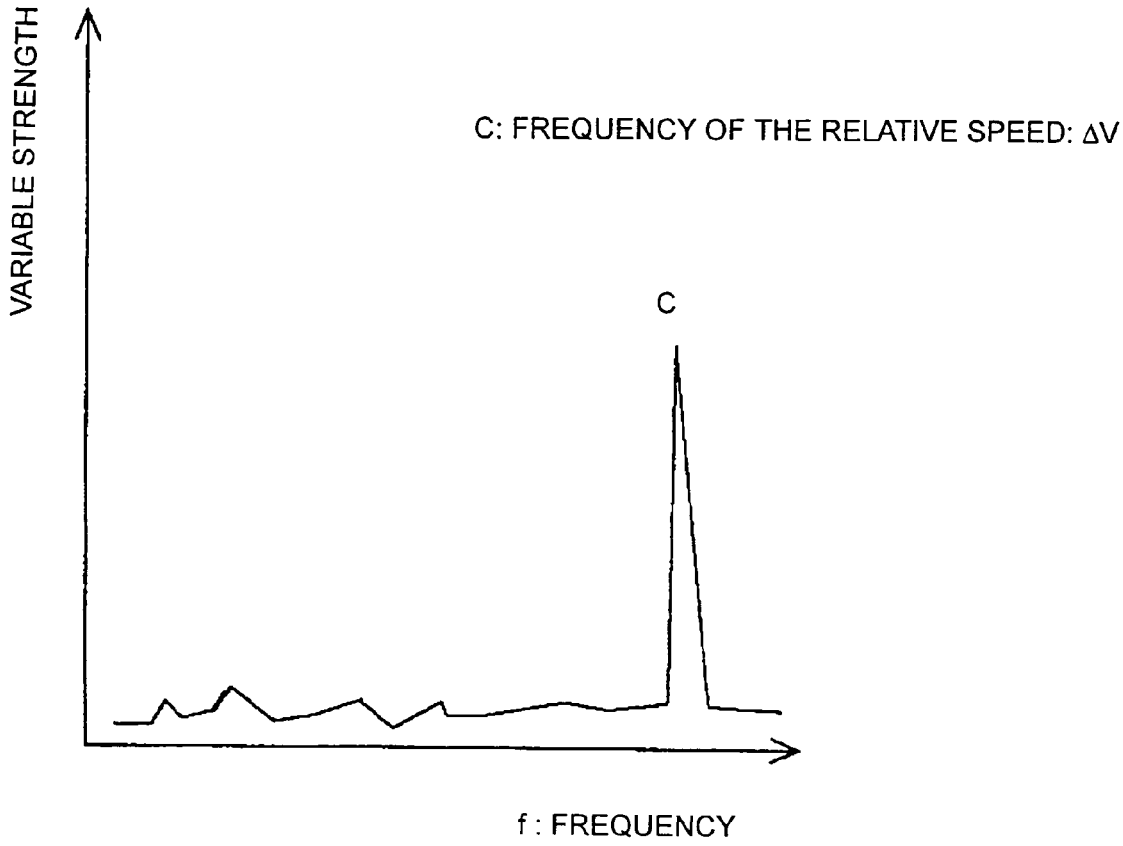
FIG. 8 illustrates a concept of a vibration spectrum of a running speed of the intermediate transfer belt when a speed variation of a high frequency is given to the running speed of the intermediate transfer belt.

FIGS. 7A, 7B, and FIG. 8 illustrate a concept of the speed spectrum (i.e., frequency characteristics of a speed variation) of the running speed of the intermediate transfer belt 9041. Based on the feedback control, the low-frequency variation components can be removed as shown in FIG. 7B, and an optional high-frequency relative speed component is provided as shown in FIG. 8. This is similarly applied to the photosensitive members 903B, 903Y, 903M, 903C.

Figure 1:
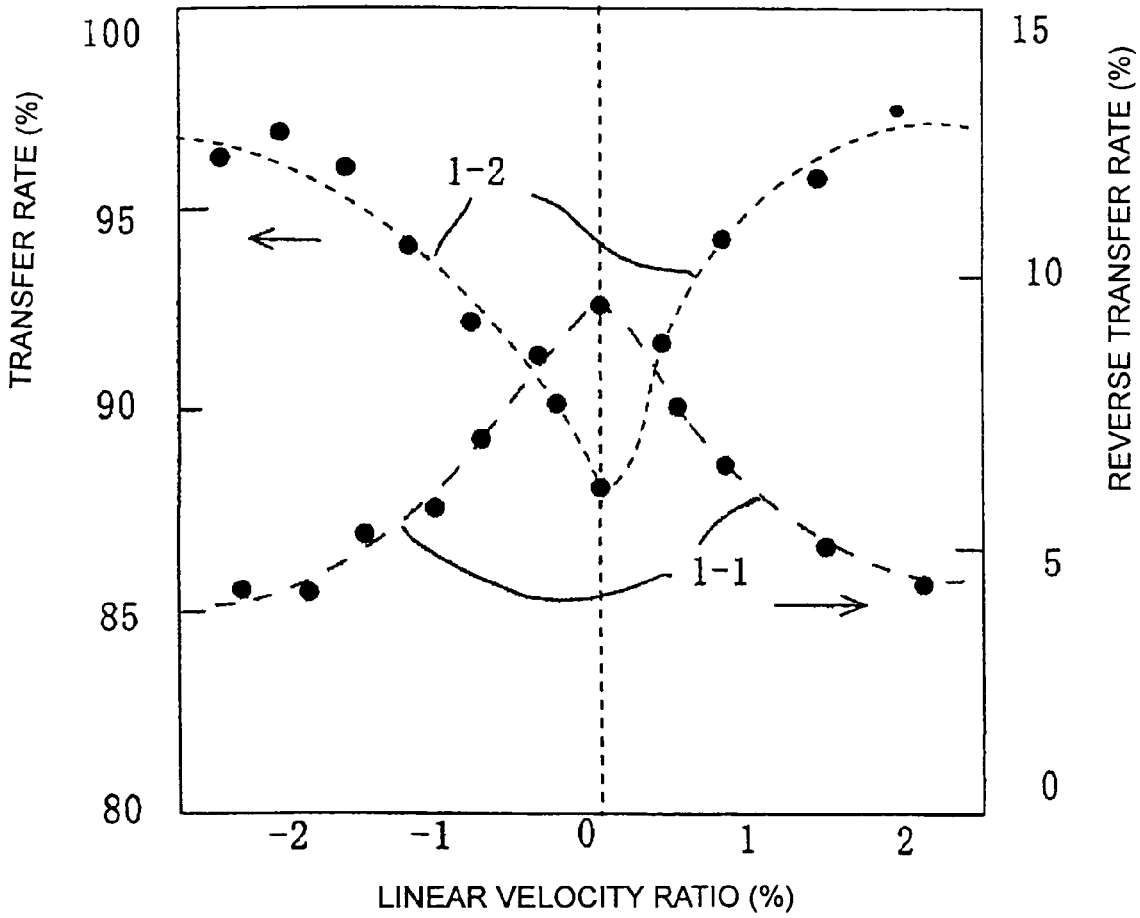
FIG. 1 is a graph to explain a conventional technique.
Figure 2:
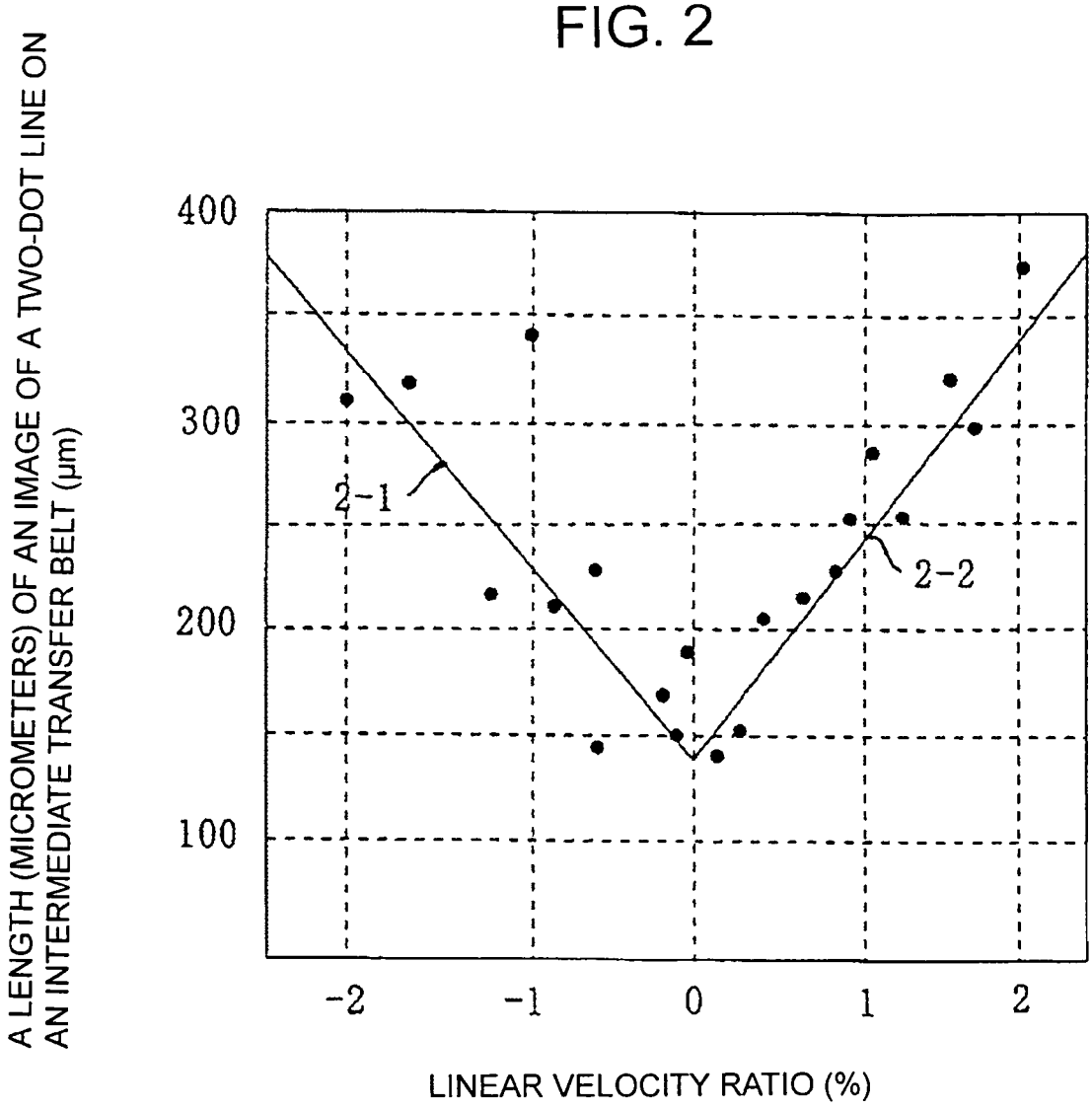
FIG. 2 is a graph to explain another conventional technique.

In the image forming apparatus shown in FIGS. 3A and 3B, a black patch is transferred as a black toner image onto the intermediate transfer belt 9041 while not giving the relative speed ΔV and its vibration. After this, the operation of the apparatus is stopped while a yellow image as a second color is being prepared. At the time of transferring the yellow patch that is formed as the Y toner image, the quantity of the reverse transfer of the black toner, forming the black patch on the intermediate transfer belt, to the non-image portion of the photosensitive member 903Y is measured. At the same time, the transfer rate of the yellow patch from the photosensitive member 903Y onto the intermediate transfer belt 9041 is also measured. As a result, the transfer rate is 94%, and the reverse transfer rate is 8%, as shown in FIG. 1.

The transfer rate and the reverse transfer rate are measured according to the weight measuring method of adhering the toner (i.e., transfer residual toner, and reverse transferred toner) on the photosensitive member onto an adhesive tape of which weight is measured in advance, and subtracting the weight of the toner from the weight of the adhesive tape of before the measurement. In other words, the transfer rate is obtained based on the comparison between the weights of the photosensitive member before and after the transfer of the toner. The reverse transfer rate is obtained based on the comparison between the weight of the toner on the intermediate transfer belt before the transfer and the weight of the toner that returns onto the photosensitive member after the transfer.

The photosensitive members 903B, 903Y, 903M, 903C are driven at a constant running speed V=245 mm/s. The vibration of the relative speed ΔV of α=2% and the frequency f=1.5 kilohertz (six times/mm) are given to the intermediate transfer belt 9041. As a result, the transfer rate improves to 97%, and the reverse transfer rate decreases to 5%.

Table 1 gives a result of changing the coefficient α while keeping the frequency f constant.

TABLE 1

| Maximum relative speed rate α (%) | Transfer rate (%) | Reverse transfer rate (%) |
|---|---|---|
| 0 | 94 | 8 |
| 0.5 | 94 | 7 |

TABLE 1-continued

| Maximum relative speed rate α (%) | Transfer rate (%) | Reverse transfer rate (%) |
|---|---|---|
| 1 | 96 | 5 |
| 2 | 97 | 3 |
| 5 | 98 | 3 |
| 10 | 98 | 2 |

When the amplitude of the relative speed ΔV increases (i.e., when the coefficient α becomes large), the transfer rate improves and the reverse transfer rate decreases. This effect becomes noticeable when the coefficient α is about 1%, and saturates when the coefficient α becomes about 5%. The effect of the reduction in the reverse transfer rate is more remarkable. At the same time, an image of one dot line of about 50 micrometers is also formed at every other line in the main scanning direction (i.e., the axial direction of the photosensitive member), and a reduction in the resolution is checked. As a result, when about 10% is given as the relative speed rate α, no change is observed in the image quality.

In the above example, another experiment is also carried out. The running speed of the intermediate transfer belt is set constant, and the running speed of the photosensitive member is changed in vibration at the relative speed ΔV. This experiment gives a result similar to that obtained above.

As explained above, the toner image transfer method and the toner image transfer device according to the present invention can effectively decrease the reverse transfer of the toner image and effectively improve the transfer rate. The toner image transfer method and the toner image transfer device do not damage the resolution of the transferred toner image. Therefore, the image forming apparatus that uses the toner image transfer device according to the present invention can form an image of satisfactory image quality in high transfer efficiency.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A method for transferring a toner image from a latent image carrier to a transfer image carrier, comprising:

running the latent image carrier at a reference running speed VA and running the transfer image carrier at a reference running speed VB, wherein VA=VB; and transferring the toner image from the latent image carrier to the transfer image carrier while controlling at least one of the latent image carrier and the transfer image carrier in such a manner that a relative speed ΔV between the latent image carrier and the transfer image carrier is changed to positive and negative sides of an average reference running speed V, where V=VA=VB, wherein the transferring includes controlling either one or both of the latent image carrier and the transfer image carrier in such a manner that the relative speed ΔV varies in approximately a sinusoidal wave shape, with respect to time, around the average reference running speed V.

2. A method for transferring a toner image from a latent image carrier to a transfer image carrier, comprising:

running the latent image carrier at a reference running speed VA and running the transfer image carrier at a reference running speed VB, wherein VA=VB; and transferring the toner image from the latent image carrier to the transfer image carrier while controlling at least one of the latent image carrier and the transfer image carrier in such a manner that a relative speed ΔV between the latent image carrier and the transfer image carrier is changed to positive and negative sides of an average reference running speed V, where V=VA=VB, wherein a frequency f(hertz) of the relative speed ΔV is such that the ratio of frequency to ΔV is equal to or more than 4/mm.

3. The toner image transfer method according to claim 2, wherein the frequency of the relative speed ΔV varies with respect to time.

4. A method for transferring a toner image from a latent image carrier to a transfer image carrier, comprising:

running the latent image carrier at a reference running speed VA and running the transfer image carrier at a reference running speed VB, wherein VA=VB; and transferring the toner image from the latent image carrier to the transfer image carrier while controlling at least one of the latent image carrier and the transfer image carrier in such a manner that a relative speed ΔV between the latent image carrier and the transfer image carrier is changed to positive and negative sides of an average reference running speed V, where V=VA=VB, wherein when the variation of the relative speed ΔV around the reference running speed V (mm/s) of the latent image carrier and the transfer image carrier respectively is expressed, by using a standardized waveform g(t) of the variation and a coefficient α, as $$\Delta V=\alpha\cdot V\cdot g(t),$$

a reference frequency f(hertz) of the variation of the relative speed ΔV, the coefficient α, the average reference speed V, and the waveform g(t) satisfy a condition $$d>\alpha\cdot V\cdot\int_{t=0}^{1/(2f)} g(t)\cdot dt,$$

for a minimum resolution distance d (millimeters) that is desired for the toner image which is transferred.

5. The toner image transfer method according to claim 4, wherein when the waveform g(t) can be approximated by a sinusoidal wave of the frequency f (hertz) and also when the relative speed ΔV is $$\Delta V=\alpha\cdot V\cdot\sin(2\pi ft),$$

the coefficient α, the average reference speed V, and the frequency f satisfy a condition:

$$d>\alpha\cdot V/(\pi f)\text{(millimeters)}$$

for the minimum resolution distance d (millimeters) that is desired for the toner image which is transferred.

6. A toner image transfer device comprising:

a latent image carrier with a toner image;

a transfer image carrier onto which the toner image from the latent image carrier is to be transferred;

a latent image carrier driving unit that drives configured to drive the latent image carrier at a reference running speed VA;

a transfer image carrier running unit configured to run the transfer image carrier, while bringing the transfer image carrier into contact with the latent image carrier, at a reference running speed VB that is substantially equal to the reference running speed VA of the latent image carrier driving unit;

a transfer image carrier driving unit configured to drive the transfer image carrier running unit;

a transfer unit configured to apply a transfer voltage to a contact portion between the latent image carrier and the transfer image carrier; and a controller configured to control at least one of the latent image carrier driving unit and the transfer image carrier driving unit in such a manner that a relative speed ΔV of the between the latent image carrier and the transfer image carrier is changed to positive and negative sides of an average reference running speed V, where V=VA=VB, wherein the controller is further configured to change mutual phases of the latent image carrier and the transfer image carrier.

7. The toner image transfer device according to claim 6, wherein the controller is configured to control the latent image carrier driving unit so that the running speed of the latent image carrier is changed to positive and negative sides of the average reference running speed V.

8. The toner image transfer device according to claim 6, wherein the controller is configured to control the transfer image carrier driving unit so that the running speed of the transfer image carrier is changed to positive and negative sides of the average reference running speed V.

9. The toner image transfer device according to claim 8, comprising a plurality of the latent image carriers disposed along a running path of the transfer image carrier, wherein the transfer image carrier is brought into contact with the latent image carriers and the transfer unit applies a transfer voltage to each contact portion between each latent image carrier and the transfer image carrier so that a toner image from each of the latent image carrier is transferred onto the transfer image carrier.

10. The toner image transfer device according to claim 6, comprising a plurality of the latent image carriers disposed along a running path of the transfer image carrier, wherein the transfer image carrier is brought into contact with the latent image carriers and the transfer unit applies a transfer voltage to each contact portion between each latent image carrier and the transfer image carrier so that a toner image from each of the latent image carrier is transferred onto the transfer image carrier.

11. The toner image transfer device according to claim 6, wherein the transfer image carrier is an intermediate transfer medium.

12. The toner image transfer device according to claim 11, wherein the transfer image carrier running unit is a rotatable endless belt.

13. The toner image transfer device according to claim 11, wherein the transfer image carrier running unit is a rotatable drum.

14. The toner image transfer device according to claim 6, wherein the transfer image carrier is sheet-shaped, and the transfer image carrier running unit is either of a rotatable endless belt and a rotatable drum, and holds and conveys the transfer image carrier.

15. An image forming apparatus comprising:

a latent image carrier with a toner image;

a transfer image carrier onto which the toner image from the latent image carrier is to be transferred;

a latent image carrier driving unit configured to drive the latent image carrier at a reference running speed VA;

a transfer image carrier running unit configured to run the transfer image carrier, while bringing the transfer image carrier into contact with the latent image carrier, at a reference running speed VB that is substantially equal to the reference running speed VA of the latent image carrier driving unit;

a transfer image carrier driving unit configured to drive the transfer image carrier running unit;

a transfer unit configured to apply a transfer voltage to a contact portion between the latent image carrier and the transfer image carrier; and a controller configured to control at least one of the latent image carrier driving unit and the transfer image carrier driving unit in such a manner that a relative speed ΔV between the latent image carrier and the transfer image carrier changes to positive and negative sides of an average reference running speed V, where V=VA=VB, wherein the controller is further configured to change mutual phases of the latent image carrier and the transfer image carrier.

16. The image forming apparatus according to claim 15, comprising a plurality of the latent image carriers disposed along a running path of the transfer image carrier, wherein the transfer image carrier is brought into contact with the latent image carriers and the transfer unit applies a transfer voltage to each contact portion between each latent image carrier and the transfer image carrier so that a toner image from each of the latent image carrier is transferred onto the transfer image carrier.

17. The image forming apparatus according to claim 16, comprising three latent image carriers corresponding to magenta, yellow, and cyan.

18. The image forming apparatus according to claim 16, comprising four latent image carriers corresponding to magenta, yellow, cyan, and black.

19. The image forming apparatus according to claim 16, wherein the transfer image carrier running unit is either of a rotatable endless belt and a rotatable drum.

20. The image forming apparatus according to claim 16, wherein the transfer image carrier running unit is either of a rotatable endless belt and a rotatable drum, and the image carrier running unit holds and conveys the transfer image carrier.

21. The image forming apparatus according to claim 15, wherein the latent image carrier is a photoconductive photosensitive member.

22. The toner image transfer method of claim 2, wherein the frequency (f) of the average relative speed ΔV is such that the ratio of the frequency to the average relative speed is equal to or more than 6/mm.

* * * * *